United States Patent [19]

Bloch, Jr.

[11] 4,220,867

[45] Sep. 2, 1980

[54] NECK X-RAY PROTECTIVE SHIELD

[76] Inventor: Winston N. Bloch, Jr., 4525 North Frederick Ave., Milwaukee, Wis. 53211

[21] Appl. No.: 925,804

[22] Filed: Jul. 18, 1978

[51] Int. Cl.[3] ..... G21F 3/02

[52] U.S. Cl. ..... 250/516; 250/519

[58] Field of Search ..... 250/516, 519, 515

[56] References Cited

U.S. PATENT DOCUMENTS

| | | | |
|---|---|---|---|
| 2,494,669 | 1/1950 | Lubow | 250/516 |
| 3,052,799 | 9/1962 | Hollands | 250/516 |
| 3,093,829 | 6/1963 | Maine | 250/516 |
| 3,123,831 | 3/1964 | Wells et al. | 250/516 |
| 3,233,248 | 2/1966 | Bushnell | 250/516 |
| 3,569,713 | 3/1971 | Via | 250/516 |

*Primary Examiner*—Bruce C. Anderson

*Attorney, Agent, or Firm*—Andrus, Sceales, Starke & Sawall

[57] ABSTRACT

A neck x-ray protection shield includes a lead sheet secured within a synthetic foam pad member which is covered with a suitable cloth such as cotton. The lead sheet is selected of a length and width to provide a front and side neck enclosure. The pad member extends from the lead sheet, with suitable fasteners such as "Velcro" elements secured to the opposite ends. The unit is wrapped around the neck and the ends connected to form a collar resting on the patient's chest and with the collar in spaced relation to the neck portion for producing proper protective position in the presence of movement of the head, neck and shoulders of the patient. The foam pad defines a cushion support permitting the comfortable attachments of the shielding collar to the various sized patients.

2 Claims, 7 Drawing Figures

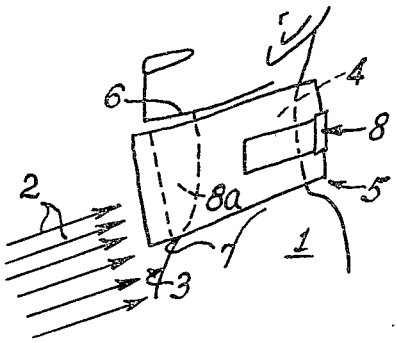
FIG. 1
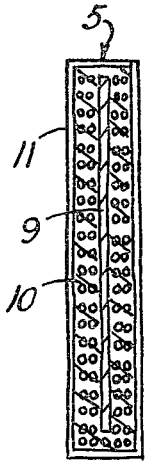
FIG. 4
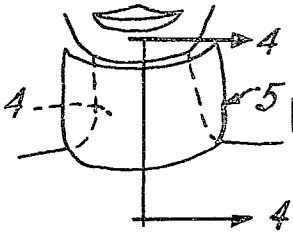
FIG. 2
FIG. 7
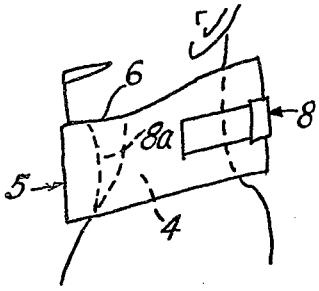
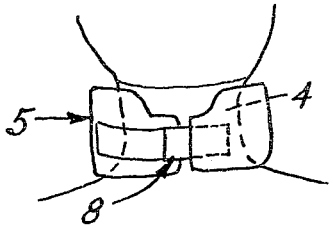
FIG. 3
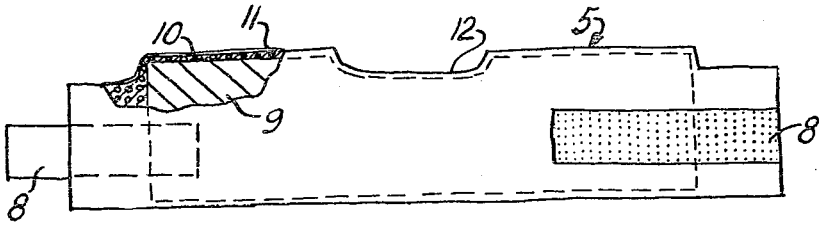
FIG. 5
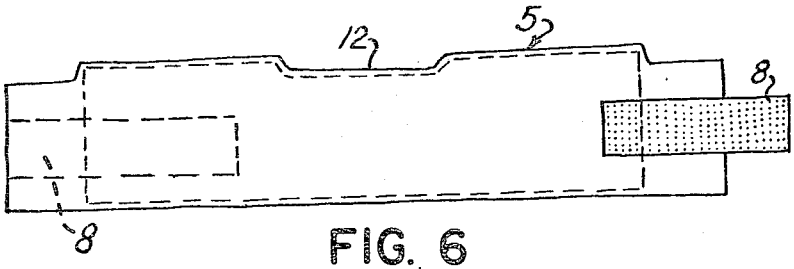
FIG. 6

NECK X-RAY PROTECTIVE SHIELD

BACKGROUND OF THE INVENTION

This invention relates to a neck x-ray protective shield unit for protecting the various body structure of the neck area during frontal exposure of the body and x-rays.

X-ray treatments are widely employed for diagnosis and or curative treatment of patients. Although the level of x-ray of the patient may not present a significant danger to the patient in many instances, certain body structures are particularly susceptible to x-ray and the like and protective shields have been provided to restrict the unnecessary exposure of the body of the patient as well as personal administering the x-ray treatment. Various apron type devices have been suggested for example. Although the aprons and general front coverage members have been widely employed, they generally extend only to the neck portion to primarily cover the body portion. For dental x-ray processes a special thyroid gland protector had been suggested in the form of a crescent shaped shield unit. The shield is especially formed to fit closely about the neck and the ends interconnected to each other behind the neck. The x-rays passing downwardly through the jaw area toward the neck are totally blocked, thereby providing protection to the thyroid gland which may otherwise be permanently damaged from treatment of X-rays thereto. The shield in accordance with conventional practice employs a suitable lead based sheet of suitable thickness such as rubber impregnated with lead, barium oxide or the like. Such material is employed to establish a flexibility permitting close attachment of the shield about the neck and particularly with the upper end of the member immediately adjacent to the neck and extending downwardly therefrom to cover the front portion of the neck.

SUMMARY OF THE PRESENT INVENTION

The present invention is particularly directed to a neck x-ray protector or shield which is employed while x-raying a patient from the front of the body and is especially constructed to provide a highly effective and essentially total protection of the several neck body structures which are particularly susceptible to x-rays, such as the carotid arteries as well as the thyroid gland, the lymph glands, and the like. Prolonged exposure or repeated application over a period of time can lead to radiation induced changes in such structures which may adversely affect the health of a patient and medical personnel and others in the vicinity of the x-ray equipment. Reference is specifically made to the patient for convenience and simplicity of descriptions. Generally in accordance with the teaching of the present invention, a flexible x-ray shield material is provided having an essentially rectangular construction and of a depth in excess of the normal depth of the patient's neck and of length which at least encloses the front and sides of the neck. Interconnecting tab or tie means are provided for interconnecting the opposite ends of the shield and developing an annular collar or ring-shaped shield. In use, the shield is applied to the patient in somewhat spaced relation to the neck and support by the upper chest so as to totally enclose all of the important neck structures for various sizes of patients. The spaced location of the unique neck shield provides effective protection while permitting limited movement of the neck, head, shoulders and the like.

More particularly, in accordance with a preferred embodiment of the present invention, the x-ray neck shield consists of a rubberized lead sheet generally on the order of 0.25 to 0.50 millimeters lead equivalent. The lead sheet is secured within a synthetic plastic foam neck member which is covered with a suitable cloth such as cotton. The lead member or sheet is selected of the desired length and width in accordance with the above description to provide a front and side neck enclosure. The foam member extends therefrom with suitable fastening means extending from the opposite ends such as the known "Velcro" type fastening elements. The foam pad thus projects in all directions from the lead shield and defines a cushioning support permitting the comfortable attachments of the shield to the various sized patients with the neckpiece resting on the patient's chest in spaced relation to the neck portion such as to maintain a proper protective position in the presence of movement of the head, neck and shoulders of the patients. The cloth covering will provide for absorption of the moisture and the like and provide a rather warm comfortable feeling to the patient's skin. It will also permit appropriate cleaning of the member and can be made as a removeable item. In a particular construction the unit can be formed with a small offset central portion to accommodate the lower portion of the jaw of the patient.

The present invention thus provides not only a highly improved shield and protective means but one which can be readily constructed employing available materials and processes. The shield also provides a very comfortable unit for use by different patients.

BRIEF DESCRIPTION OF DRAWINGS

The drawing furnished herewith illustrates a preferred construction of the present invention in which the above advantages and features are clearly disclosed as well as others which will be readily understood from the following description.

In the drawing:

FIG. 1 is a side elevational view of the patient with the protective shield applied;

FIG. 2 is a front elevational view of the patient shown in FIG. 1;

FIG. 3 is a back elevational view of the patient shown in FIGS. 1 and 2;

FIG. 4 is a sectional view taken generally on line 4—4 of FIG. 2;

FIG. 5 is an elevational view of a shield unit such as shown in FIGS. 1–3, with modification to the top edge of the shield.

FIG. 6 is a back view of the shield shown in FIG. 5.

FIG. 7 is a view similar to FIG. 1 shown the application of the single shield to a different sized neck.

DESCRIPTION OF THE ILLUSTRATED EMBODIMENT

Referring to the drawings and particularly to FIGS. 1 and 3, a patient 1 is shown in position for ordinary application of chest x-rays and the like. Thus, the x-rays 2 are applied to the front body portion 3 for the usual diagnosis or treatment of patient 1. Although the x-rays 2 are not necessarily intended to move into the area of the patient's neck 4, the fact of the matter is that there may well be a certain amount of x-rays which may, whether because of scattering or accidental directional application or the like, be applied to the neck region of the patient. In accordance with the present invention, a shield unit 5 is secured encircling the neck 4 between the lower jaw 6 and the chest and shoulders 7. The back ends of the shield unit 5 are provided with a suitable connecting means 8 to define a complete encircling member which rests on the chest and shoulders of the patient shown in FIGS. 1 through 3, inclusive. The shield unit 5 is generally a rectangular shaped member which when wrapped about the neck forms a ring-shaped collar to completely cover the front and the opposite sides of the neck between the jaw 6 and the chest and shoulders 7.

As shown in FIGS. 1–3, the generally rectangular shaped shield unit 5 extends essentially completely from the lower end of jaw 6 down to the chest and shoulder 7, thereby providing maximum protection to the body structures such as the carotid arteries, the thyroid glands as well as lateral lymph glands and the like. In the protective position, the ring-shaped unit is arranged to define an opening which is greater than the neck 4, of the patient 1. The shield unit 5 thus rests on the chest and shoulders 7 with a free space 8*a* between the unit 5 and the neck 4, such that limited movement of the head is permitted.

More particularly, in the illustrated and preferred construction of the present invention, the shield unit 5 includes an innermost x-ray opaque sheet or shield of rubberized lead 9 or the like. This opaque sheet 9 is fitted within a suitable resilient flexible member or layer 10 such as a synthetic plastic foam. The opaque shield 9 extends to within a short distance of the upper and lower edges of the foam member 10. In the illustrated embodiment of the invention, the resilient member also extends beyond the ends of the lead shield 9 to completely encapsulate and enclose the sheet and hold it in position. The member 10 provides soft, resilient structure while maintaining a maximum depth of the shield 9. The length of the shield 9 is selected to at least ensure protective enclosure of the front and both sides of the neck.

The flexible lead sheet may be molded within a suitable foam plastic or the like, or a sheet of foam plastic may be slit and the lead sheet embedded therein and suitable anchored as by an adhesive, thread members or the like. Any other suitable construction can, of course, be employed.

The shield unit 5 is further provided with an outer protective cover 11 which may be formed of a cotton cloth or the like. The use of an outer cloth or cover 11 contributes to the comfort of the patient, providing a relatively warm, soft skin-engaging surface.

The fastening means 8 may be of any suitable construction such as a releasable overlapping fastening material sold under the "Velcro" trademark. This provides a very convenient means of releasably attaching of the shield about the patient's neck.

The special resilient construction not only provides a very comfortable shield unit but permits its ready adaption to various sized personnel, as the top and the bottom portions will readily deflect to conform to the patient, for example, as shown in FIG. 7. This view thus shows the same shield unit applied to a patient having a shorter neck length. As shown, the soft resilient foam layer 10 merely deflects to conform to the patient's neck.

In addition, it is believed clear from the illustrations of FIGS. 1 and 3, that even patients with substantially shorter necks can be readily protected with the same shield. Thus, if the neck length should even by shorter than the depth of vertical width or the inner lead shield material or sheet, its flexibility is such that is would readily conform to the patient's neck, being deflected between the jaw and neck portion. In the alternative, the collar diameter may be enlarged with the upper end of the collar positioned upwardly over the forward jaw, but with the annular encircling neck shield unit 5 being otherwise supported by the chest and shoulder 7 of the patient as in FIGS. 1 and 3.

In all cases, the present shield unit 5 thus essentially provides complete shielding of all exposed neck portions including within the front and two sides of the neck to provide maximum protection against x-rays and the like.

The rectangular shaped shield may be modified in various respects such as including a front notched area to accommodate the lower jaw portion where it is desired to maintain the front edge underneath the jaw. The modified shield unit 5 is shown in FIGS. 5 and 6 with the upper edge provided with the shallow notch 12.

A practical shield unit 5 such as shown in FIGS. 5 and 6 was constructed with a total length of approximately 52 centimeters, and a depth of 12 centimeters with a notched depth of 9½ centimeters. The shield itself had a length of approximately 395 centimeters and a depth of approximately 11 centimeters.

The present invention may also be advantageously constructed as an integrated part of the conventional protective apron structures presently in use by the operating medical personnel and the like. For example, a hinged connection means may be provided between the bottom center portion of the neck shield and the center top portion of an apron. In use the collar shield would thus fit about the neck and rest on the chest and shoulders as a result of the hinged connection.

The present invention thus provides a highly effective and improved neck shield for protecting of a patient obtaining front body x-ray treatment and/or other personnel in the vicinity of x-ray equipment to prevent damage to the several body structures in the neck area. The shield unit is readily and conveniently applied to various sized patients and provides a very comfortable shield which permits the patient to have head, neck and shoulder movement without destroying of the effective shielding.

Various modes of carrying out the invention are contemplated as being within the scope of the following claims, particularly pointing out and distinctly claiming the subject matter which is regarded as the invention.

I claim:

1. A protective neck shield unit for blocking of frontal chest X-rays applied to personnel in the vicinity of x-ray equipment comprising a flexible sheet-like shield of a material opaque to X-rays, said shield being a rectangular member having a constant width and depth corresponding to the neck portion of personnel, means for holding shield in a circular configuration to define an encircling collar member for totally encompassing the front and side areas of the neck and with said front portion of the collar being spaced outwardly from the neck, said collar member having a lower edge adapted to rest on the chest and shoulder of the patient to support the collar member and extending upwardly therefrom to totally encompass the front and sides of the neck whereby the body portion in the total neck area susceptible to damage from chest X-rays are totally protected.

2. The shield unit of claim 1, including a foam pad, said shield being embedded within said foam pad with said foam pad extending outwardly from the upper and bottom edges thereof, said foam pad defining deflectable portions whereby the shield can be located between the lower jaw and chest of a patient.

* * * * *